US008869330B1

(12) United States Patent
Arvisais

(10) Patent No.: US 8,869,330 B1
(45) Date of Patent: Oct. 28, 2014

(54) MULTIFUNCTIONAL TOOL FOR AUTOMOTIVE AIR CONDITIONING SYSTEM TESTING AND MAINTENANCE

(71) Applicant: Jerold H Arvisais, Auburn, WA (US)

(72) Inventor: Jerold H Arvisais, Auburn, WA (US)

( * ) Notice: Subject to any disclaimer, the term of this patent is extended or adjusted under 35 U.S.C. 154(b) by 0 days.

(21) Appl. No.: 14/022,817

(22) Filed: Sep. 10, 2013

(51) Int. Cl.
*B25F 1/00* (2006.01)
*B25B 23/00* (2006.01)
*B25B 27/00* (2006.01)

(52) U.S. Cl.
CPC ..... *B25B 27/0035* (2013.01); *B25F 1/00* (2013.01)
USPC ..... 7/100; 81/461

(58) Field of Classification Search
USPC ..... 81/461, 9.24, 176.1; 7/100; 29/280
See application file for complete search history.

(56) References Cited

U.S. PATENT DOCUMENTS

| | | | | | |
|---|---|---|---|---|---|
| 1,102,863 | A | * | 7/1914 | Bojas | 81/177.75 |
| 1,963,833 | A | * | 6/1934 | Cullnan | 81/111 |
| 2,522,038 | A | * | 9/1950 | Houghton | 81/176.15 |
| 2,748,458 | A | | 6/1956 | Knudsen | |
| 2,794,354 | A | * | 6/1957 | Cozart | 81/484 |
| 2,882,591 | A | * | 4/1959 | Grossman | 29/213.1 |
| 3,561,090 | A | | 2/1971 | Fritch | |
| 4,305,193 | A | * | 12/1981 | Anderson | 29/213.1 |
| 4,572,040 | A | * | 2/1986 | Metz | 81/463 |
| 4,573,378 | A | | 3/1986 | McDonald | |
| 4,625,353 | A | * | 12/1986 | Tamez et al. | 7/100 |
| 4,706,357 | A | | 11/1987 | Ewing | |
| 4,746,158 | A | * | 5/1988 | Fields | 294/94 |
| 4,765,009 | A | * | 8/1988 | Hung | 7/100 |
| 4,802,391 | A | | 2/1989 | Willhoite | |
| 5,146,813 | A | * | 9/1992 | Stanfill, Jr. | 81/120 |
| 5,450,772 | A | * | 9/1995 | Barone et al. | 81/9.24 |
| 5,638,590 | A | | 6/1997 | Silano | |

(Continued)

FOREIGN PATENT DOCUMENTS

| | | |
|---|---|---|
| CN | 2533985 Y | 2/2003 |
| WO | W09819089 | 5/1998 |
| WO | W09832996 | 7/1998 |

OTHER PUBLICATIONS

Tool Catalog, "VW / Audi Spark Plug Boot Puller and Installer", Schley Products Inc, http://sptool.com/pdf/Catalog%20PDF%2020091.pdf p. 26, publ Jan. 1, 2009.

(Continued)

*Primary Examiner* — Monica Carter
*Assistant Examiner* — Danny Hong
(74) *Attorney, Agent, or Firm* — K Karel Lambert; Lambert Patent Services

(57) ABSTRACT

An automotive tool for servicing air-conditioning (AC) systems equipped with quick-connect adaptors. May be used to service modern refrigerant R132A-compatible systems or retrofitted older systems. The tool is adapted for attaching, detaching, opening, and closing valved T-adaptors used to attach gas lines and pressure gauges such as required for adjusting pressure in AC systems at full operational pressure and temperature, and particularly finds use when the "hi-tap" and "lo-tap" fittings are in hard to reach places around the engine block or chassis. The tool includes swappable extension arms so that length and angular geometry may be adjusted as needed. The tool aids in avoiding injury on dangerously hot surfaces and moving fan blades or belts. Surprisingly, using two such tools, one for the high tap and one for the low tap, a mechanic may work each tool singlehandedly to complete any necessary pressure adjustments.

14 Claims, 9 Drawing Sheets

(56) References Cited

U.S. PATENT DOCUMENTS

| | | | | |
|---|---|---|---|---|
| 6,026,550 | A | 2/2000 | Silano | |
| 6,122,810 | A | 9/2000 | McInnes | |
| 6,253,436 | B1 | 7/2001 | Barjesteh | |
| 6,321,432 | B1 | 11/2001 | Przybyla | |
| 6,574,843 | B1 | 6/2003 | Meadows | |
| 6,612,005 | B2 * | 9/2003 | Rivers | 29/221.5 |
| 6,792,658 | B2 | 9/2004 | Capoferi | |
| 7,987,571 | B2 | 8/2011 | English | |

OTHER PUBLICATIONS

Tool Catalogy, "Mercedes Benz Special Service Tools", Samstag Sales, http://samstagsales.com/mercedes.htm. See KL-0369-45 figure under text; See Klann KL-0320, dated Jun. 27, 2013.

Search Document/Cardinal IP, "Automotive Tool for Use in Service on Vehicle having a Difficult-to-Access Quick-Connect Valve", dated Jun. 28, 2013.

* cited by examiner

Fig. 3A
(WORKPIECE)
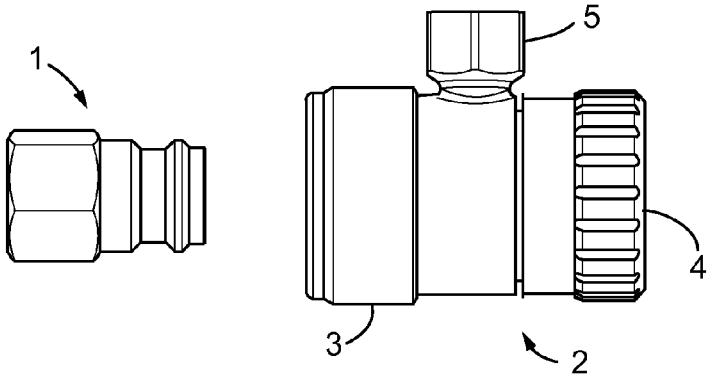
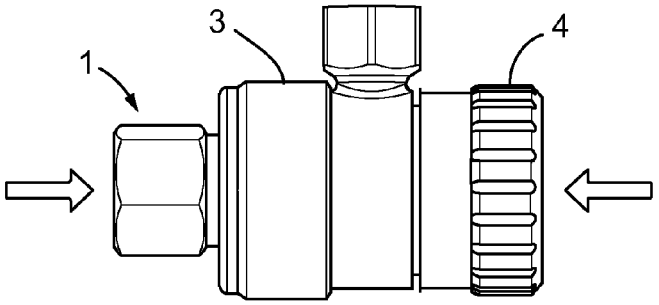
Fig. 3B
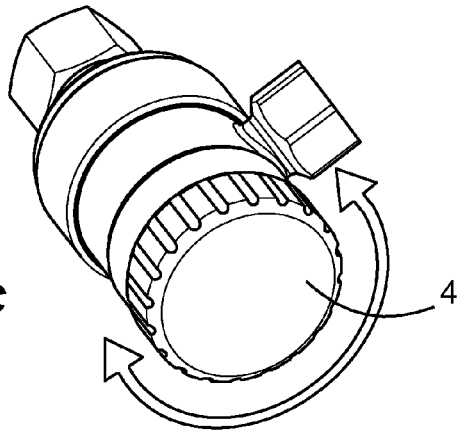
Fig. 3C

MULTIFUNCTIONAL TOOL FOR AUTOMOTIVE AIR CONDITIONING SYSTEM TESTING AND MAINTENANCE

GOVERNMENT SUPPORT

Not Applicable.

FIELD OF THE INVENTION

This invention is related to a multifunctional maintenance tool and methods for servicing automotive air-conditioning systems. The tool includes a claw adapted to install and remove quick-connect valves and also a finger-like actuator rod adapted to open and close the valves when required.

BACKGROUND

Modern automatic air conditioning (AC) systems provide cooling for comfort while driving. Generally described, the AC cycle includes four basic stages: 1) a saturated vapor of a refrigerant, generally 1,1,1,2-tetrafluoroethane (R134A) [or chlorofluorocarbons sold under the trademark FREON®], is compressed by an in-line compressor to high pressure and forms a superheated vapor; 2) the compressed vapor is stripped of excess heat and condenses in a heat exchanger (termed a condenser coil), generally by transferring rejected heat to an ambient airstream drawn or blown across the coil; 3) the saturated liquid is then passed through an expansion device, termed here a "Venturi" (an in-line flow constrictor typically known as an "expansion valve" or a "throttle tube"), that results in a pressure drop and a phase change of at least some of the liquid to a gas by a process known as "adiabatic flash evaporation". The chilled vapor is then pumped to a second heat exchanger and blower combination and used to cool the vehicle's interior; 4) finally, the exhausted vapor is returned to the compressor and the cycle renews. Variations of this basic AC cycle are known and also may require the tool described here.

Thus servicing these systems requires close contact with hot surfaces, fan blades, and belts used to drive the compressor and the blowers. Moreover, servicing generally must be performed when the AC system is operating at steady state so that the pressure drop in the Venturi can be set to factory specifications. Before that, it may be necessary to open the system (without releasing refrigerant into the atmosphere) and to supply fresh refrigerant, a tightly regulated process because of the danger the released gases pose to the Earth's ozone shield.

When the correct pressure drop is not obtained, or system performance weakens, it may be necessary to add gas. Typical systems contain 2.5 to 3.5 pounds of refrigerant, which is expensive and heavily regulated. For this reason, gas-tight quick-release nipples (or "taps") have been developed that allow a licensed mechanic to access the system upstream and downstream of the Venturi, to add or remove gas through a valved "tee", and to enable pressure gauges during adjustments on the system. These taps are generally placed around the engine block and evaporator and often end up in cramped and difficult to access cavities, such as between the radiator and the evaporator. Mechanics may develop open sores and burns because of repeated damage to the knuckles and wrists that occurs during installation of system test valves on the quick-connect fittings and when making the required adjustments. Unfortunately, the high and low taps that must be accessed for testing and maintenance frequently are placed in poorly accessible cavities within the engine department.

Thus, servicing automotive air-conditioning systems can be a hot and dangerous job. Adjustments are generally made at full temperature and pressure while the AC system is in operation, and finger and hand damage frequently results from the required close contact with hot surfaces and moving parts such as belts and fan blades. Steady state conditions for proper adjustment of an AC system require that the temperature be 93 degrees Celsius or higher (200° F.).

Correct adjustment of the fluid pressure in the AC system is necessary to ensure proper operation and helps to minimize the overall consumption and waste of these environmentally dangerous refrigerant gases.

Clearly, there is a need in the art for a tool that overcomes the above dangers and disadvantages when working with inaccessible quick-connect valves and nozzles during AC system service. The tool must be capable of multiple functions that a mechanic would otherwise perform by hand. The tool must assist the mechanic in positioning a valve T-adapter over a tap in blind positions, the quick-connect locking sleeve of the adaptor must then be depressed so as to engage the tap nipple and released when in place to form a gas-tight seal, and the valve on/off knob must then be opened. Typically the "tee" is connected through a manifold to a reservoir for receiving waste gas or a fresh gas reservoir attached to recharge the system. These steps are required to improve performance of depleted systems and to retrofit the older FREON®-based systems with the newer R134A. Generally a pair of pressure gauges are used: one at the high pressure tap, and the other at the low pressure tap. After the $\Delta P$ across the Venturi is adjusted per the manufacturer's specifications, the test fittings and gauges must be removed. To remove the valve T-adapters, the valve is first securely closed and the valve assembly is then physically compressed to force the quick-release sleeve into its unlocked (depressed) position. While maintaining compression, the sleeve can be released from its engagement on mated lips formed on the nipple of the tap. Preferably, these operations would be performed with a single tool in a stepwise sequence so that the valve assembly remains captive in the tool head for easy recovery. No ordinary tool of the art suffices to perform all of these operations without dangerous release of gas and without potential injury to hands and fingers.

It is also known that the geometry and accessibility of AC systems varies according to the vehicle make and model. Tap adaptor fittings may also vary in dimensions. Thus it is desirable that a tool be conceived which permits these operations without requiring the mechanic to have a completely different tool for each vehicle type.

A solution to these interrelated problems is only achieved by trial and error. There has been a long-standing need for a tool that overcomes these difficulties. Only a tool that can install and remove a quick-connect valve and can, without releasing the valve, rotatingly open and close the valve is sufficient to solve the problem. Many burned knuckles have led me to the solution disclosed here.

SUMMARY

The invention is related to an apparatus and method for servicing AC systems fitted with quick-connect tap adaptors upstream and downstream from the Venturi. Hereafter, the quick-connect tap adaptor or valve T-adaptor (including any accessories such as a gas supply tube or pressure gauge) is termed a "workpiece". The workpiece is operated on by the tool, but the workpiece is a conventional fitting and is not part of the invention. The inventive apparatus is an improved automotive hand tool for AC system service requiring use of one or more difficult-to-access quick-connect valves of the type used for R134A-compatible air-conditioning systems. The tool comprises a mechanical claw formed as a hollow cylinder, the cylinder having a partially enclosing rigid wall, a closed base, and a top opening with top rim, the wall of the claw having a side opening extending from the top rim down the wall on one side so that the workpiece can be inserted into and removed from the claw. When properly inserted, the workpiece is disposed with a valve on/off knob directed at the inside base of the claw and the quick-lock female fitting (for receiving the male tap nipple) is directed at the top opening of the claw. The top rim is folded inward to form a protruding lip for retaining the workpiece within the cylinder and for engaging the quick-connect locking sleeve. The rim aids in compressing the quick-connect locking sleeve to engage and to release the valve from the nipple tap. The side opening is dimensioned for accommodating a sidearm or "Tee" so that attachments to the workpiece may be supported by the tool. The tool also comprises a guide sleeve attached to or through the base of the claw, the guide sleeve serving as an extension handle for the claw and having an internal hollow center with a tubular opening through the base of the claw at a first end and a handle at a second end. Also part of the tool assembly is a mechanical finger formed as an actuator rod. The actuator rod is dimensioned to slide up and down inside the guide sleeve, generally with a spring mount, and will also rotate in the guide sleeve as needed to open and close the valve on/off knob within the claw. The actuator rod extends through the opening into the claw and is fitted on a first end with a nose having a friction tip for engaging the valve on/off knob of the workpiece. The actuator rod is fitted on a second end, i.e., the control end, with a knob or ball for manually extending and turning the actuator rod. The rod extends beyond the second end of the guide sleeve so that the actuator rod may be forced and turned against the workpiece inside the claw by pushing on the control knob. The control knob and the handle of the guide sleeve may be operated cooperatively with a single hand when positioning and attaching the valve to a nipple tap, but may require a second hand when rotating the control knob to open or close the valve knob, as will be described in more detail below.

In operation, the actuator rod has multiple functions and positions. Included among these are:

i) a neutral position for loosely loading a workpiece in the claw;

ii) an extended position for depressing a quick-connect release sleeve on a workpiece against the rim of the claw when attaching or detaching the valve adaptor from a nipple of an air-conditioning system, iii) an intermediate position for rotating the valve on/off knob so as to open and close the valve while seated in the claw, either on a nipple or disengaged from a nipple; and iv) a retracted position for removing the workpiece from the claw, such as when a job is completed.

Surprisingly, in use the tool provides a stronger and more steady grip on the workpiece than the mechanic's own hand, speeding and increasing the reliability of the steps of the operation and helping to minimize release of ozone-depleting gases (such as when the quick release locking ring fails to seat properly). The nose of the actuator tool provides a firm pressure against the top rim or inside lip of the claw so that the locking ring is firmly compressed during installation and can be released when the valve is fully seated on the male nipple of the AC system tap.

The nose of the actuator rod is also modified with a friction surface so as to turn a valve on/off knob of a quick-connect valve when contactingly engaged thereto. In practice, a stiff rubber or silastic suction cup has proved durable and effective in opening and closing the valve on/off knob. The guide sleeve may be angled so as to contact the actuator nose substantially at the center of a valve on/off knob held in the claw so as to improve the turning action exerted on the valve on/off knob.

The claw may be a standard size for receiving a conventional quick-connect T-valve and the guide sleeve and actuator rod are optionally interchangeable according to the kind of vehicle in need of air conditioning service. Thus in a first alternate embodiment, a longer length extension sleeve and mated actuation rod may be threaded into the base of the claw. Extension handle assemblies of several lengths may be provided in a kit with a single claw member if desired. Optionally, a kit of tools may be supplied, the kit including a selection of extension handles and a plurality of claw heads if needed to service quick-connect fittings having larger dimensions. These kits are sold in box sets with pockets formed for each tool piece, or may be sold individually according to the make of vehicle to be serviced. Kits may also be provided including separate tools for servicing Schrader valve assemblies of the valve adaptors.

In yet another alternate embodiment, the base of the claw is threaded to be removable so that an added range of extension handle compatibility is achieved. Threaded baseplate members may be provided to receive more angled extension handles, for example, including handles having a curvature or terminal arc proximate to the claw, as for bending into narrow corners. In these embodiments, the actuator rod is generally made of an incompressible but flexible material such as plumber's snakes are made of so that the basic functions of exerting a compressive force on the quick-connect locking sleeve and a rotating force on the valve knob are effectively realized at a 30, 60 or 90 degree angle, for example. Intermediate angles between 0 and 90 degrees may also be achieved. In one instance, the flexible actuator rod may be a braided wire rod. Various curved extension handle assemblies may be provided in a kit with a single claw member if desired. Optionally, more than one threaded baseplate is provided in the kit so that the mechanic can fit together the tool to best match the job at hand.

The foregoing and other elements, features, steps, and advantages of the invention will be more readily understood upon consideration of the following detailed description of the invention, taken in conjunction with the accompanying drawings, in which presently preferred embodiments of the invention are illustrated by way of example.

It is to be expressly understood, however, that the drawings are for illustration and description only and are not intended as a definition of the limits of the invention. The various elements, features, steps, and combinations thereof that characterize aspects the invention are pointed out with particularity in the claims annexed to and forming part of this disclosure. The invention does not necessarily reside in any one of these aspects taken alone, but rather in the invention taken as a whole.

BRIEF DESCRIPTION OF THE DRAWINGS

The teachings of the present invention are more readily understood by considering the drawings, in which:

FIGS. 3A, 3B and 3C are selected views of a representative workpiece 2 that is operated on by the tool of the invention. In operation of the tool, the workpiece 2 is engaged and disengaged on the male tap 3. The workpiece may generally be described as a "quick-connect adapter" for seating on a nipple or "tap" of an air-conditioning system during servicing and generally may include a "tee" arm for attaching a refrigerant supply or a pressure gauge, for example.

Figure 1:
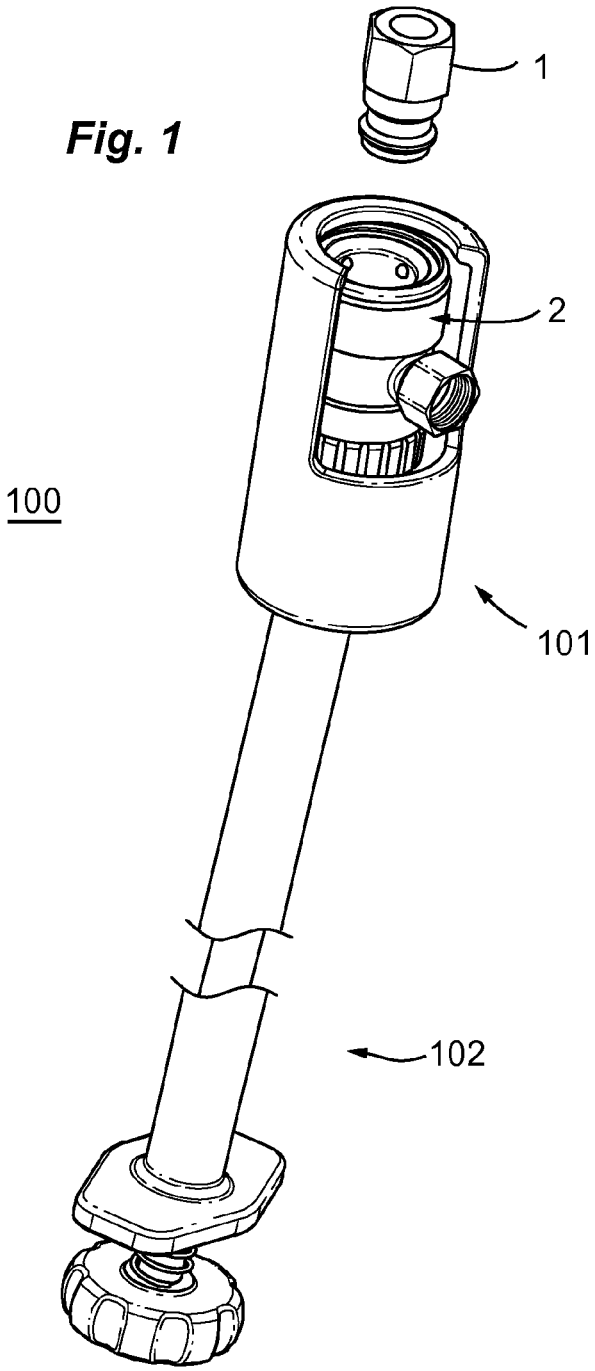
FIG. 1 is a first perspective view of an AC automotive maintenance tool 100 of the invention and a workpiece (2*a*, 2*b*) inserted therein. Also shown is a "tap" or male "nipple" (3) of an automotive AC system. The nipple or tap is fluidly connected to tubulations or manifolds of the AC system as would readily be known to one skilled in the art.

The drawing figures are not necessarily to scale. Certain features or components herein may be shown in somewhat schematic form and some details of conventional elements may not be shown in the interest of clarity, explanation, and conciseness. The drawing figures are hereby made part of the specification, written description and teachings disclosed herein.

NOTATION AND NOMENCLATURE

Certain terms throughout the following description are used to refer to particular features, steps or components, and are used as terms of description and not of limitation. As one skilled in the art will appreciate, different persons may refer to the same feature, step or component by different names. Components, steps or features that differ in name but not in function or action are considered equivalent and not distinguishable, and may be substituted herein without departure from the invention. Certain meanings are defined here as intended by the inventors, i.e., they are intrinsic meanings. Other words and phrases used herein take their meaning as consistent with usage as would be apparent to one skilled in the relevant arts. The following definitions supplement those set forth elsewhere in this specification.

Claw: a mechanical device that is curved or bent to suspend, hold, push or pull something, in more specificity an enclosure for holding a workpiece, where the enclosure is open at the top and sealed at the base, and is slotted on one side to admit the workpiece and to accommodate any sidearm attachments. The claw is also modified by a partial lip or rim extending inward from the top edge of the cylinder, the lip serving to engage the quick-connect locking sleeve or ring of a quick-connect fitting during detachment and placement of the valve on its male nipple.

Venturi: a constriction in an air-conditioning system loop between the compressor and the condenser, the Venturi having the function of adiabatically flash decompressing the supersaturated vapor through a sudden pressure drop ($\Delta P$). This feature may also be termed a "throttle tube" or an "evaporator valve" although more accurately it is termed an in-line Venturi orifice.

Workpiece: a part that is worked on; a part, piece, or an assembly that is distinguishable from the tool that works on it. In more particularity, workpiece is used here to refer to AC fitting adaptors that are operated on by the tools of the invention. Specifically, "workpiece" refers to a quick-connect adapter for AC system servicing and not to the male nipple to which the adaptor is engaged and disengaged by the action of the tool. These adaptors must be manipulated, compressed, released, opened and closed during AC service operations, and those operations are ways in which the tool works on the adaptor.

General connection terms including, but not limited to "connected," "attached," and "affixed" are not meant to be limiting and structures so "associated" may have other ways of being associated. "Fluidly connected" indicates a connection for conveying a fluid therethrough.

Relative terms should be construed as such. For example, the term "front" is meant to be relative to the term "back," the term "upper" is meant to be relative to the term "lower," the term "vertical" is meant to be relative to the term "horizontal," the term "top" is meant to be relative to the term "bottom," and the term "inside" is meant to be relative to the term "outside," and so forth. Unless specifically stated otherwise, the terms "first," "second," "third," and "fourth" are meant solely for purposes of designation and not for order or for limitation. Reference to "one embodiment," "an embodiment," or an "aspect," means that a particular feature, structure, step, combination or characteristic described in connection with the embodiment or aspect is included in at least one realization of the present invention. Thus, the appearances of the phrases "in one embodiment" or "in an embodiment" in various places throughout this specification are not necessarily all referring to the same embodiment and may apply to multiple embodiments. Furthermore, particular features, structures, or characteristics of the invention may be combined in any suitable manner in one or more embodiments.

It should be noted that the terms "may," "can," and "might" are used to indicate alternatives and optional features and only should be construed as a limitation if specifically included in the claims. It should be noted that the various components, features, steps, or embodiments thereof are all "preferred" whether or not it is specifically indicated. Claims not including a specific limitation should not be construed to include that limitation. The term "a" or "an" as used in the claims does not exclude a plurality.

"Conventional"—refers to a term or method designating that which is known and commonly understood in the technology to which this invention relates.

Unless the context requires otherwise, throughout the specification and claims that follow, the term "comprise" and variations thereof, such as, "comprises" and "comprising" are to be construed in an open, inclusive sense that is as "including, but not limited to."

The appended claims are not to be interpreted as including means-plus-function limitations, unless such a limitation is explicitly recited in a given claim using the phrase "means for."

A "method" as disclosed herein refers to one or more steps or actions for achieving the described end. Unless a specific order of steps or actions is required for proper operation of the embodiment, the order and/or use of specific steps and/or actions may be modified without departing from the scope of the present invention.

DETAILED DESCRIPTION

Figure 2:
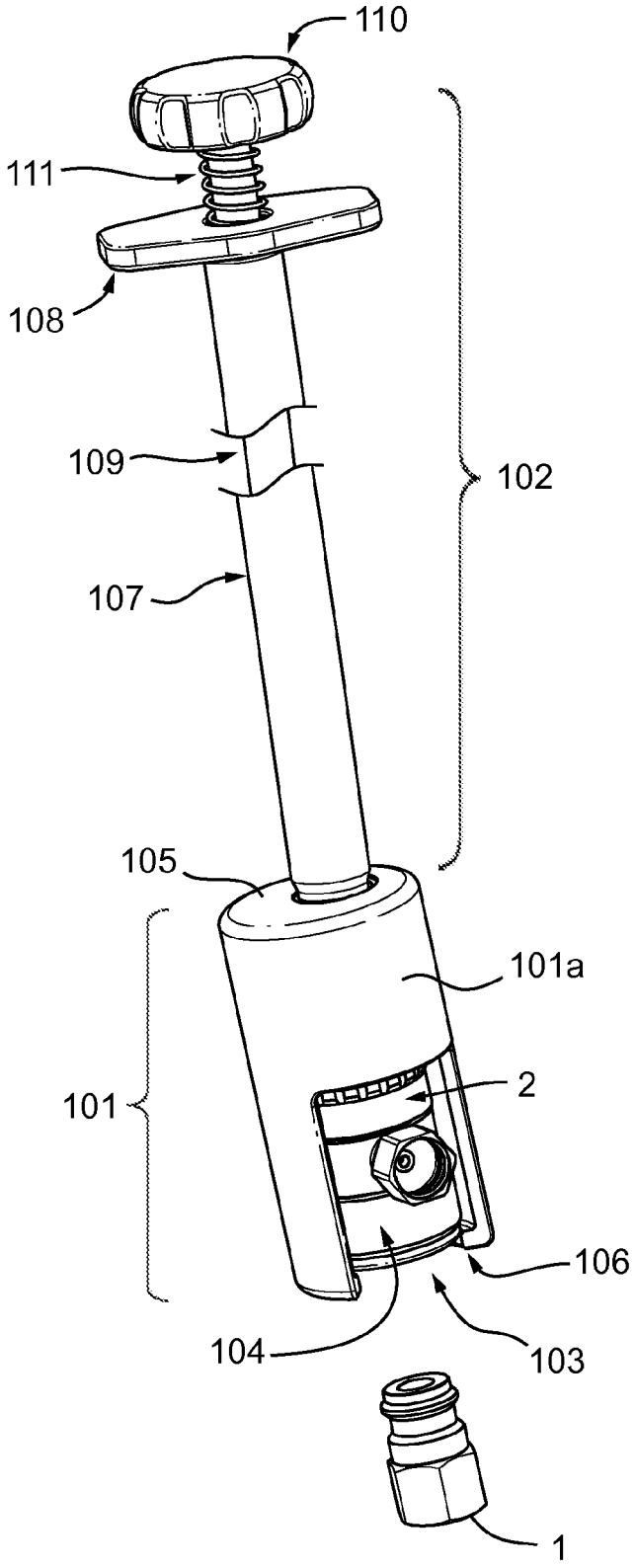
FIG. 2 is a second perspective view of an AC automotive maintenance tool 100 of the invention and a workpiece 2 inserted therein, showing parts of the tool.

Referring to FIGS. 1 and 2, two perspective views of an AC automotive maintenance tool of the invention are shown. The tool (100) of the invention is shown with a workpiece (2) held in a claw 101 mounted on an extension handle 102 of the tool. Also shown is a "tap" or male "nipple" (1) of an automotive AC system. The nipple tap 1 is fluidly connected to a tubulation or manifold of the AC system, the details of which will vary and are not otherwise illustrated here because they would readily be known to one skilled in the art.

FIG. 2 is a second perspective view of an AC automotive maintenance tool 100, including labeling of parts of the tool. Operation of the tool will be discussed further below. Marked for identification are the claw 101 or head of the tool, the extension piece 102, top opening 103 and side opening 104 in the cylindrical body of the claw (the openings for receiving the workpiece 2), forming the bottom of the cylindrical body, a base or baseplate 105, an internal lip or rim 106 at the top of the claw, a guide sleeve 107 with handlebar or hand grip 108, an actuator rod 109 within the hollow center of the guide sleeve and a control knob 110 at the bottom end of the actuator rod. Illustrated is a spring 111 mounted on the actuator rod between the control knob and the handlebar which is useful in one-handed operation of the tool. In FIG. 2 it can be seen that the guide sleeve is threaded into the base of the claw.

FIGS. 3A, 3B and 3C are selected views of a representative workpiece 2 that is operated on by the tool of the invention. In operation of the tool, the workpiece 2 is engaged and disengaged on the male tap 1. The workpiece may generally be described as a "quick-connect valve adapter" and includes a quick-connect locking ring 3, a valve knob 4, and a "tee" sidearm 5 for attaching a refrigerant supply or a pressure gauge, for example. In FIG. 3B the valve assembly is shown with nipple engaged. To disengage the nipple, quick-connect lock ring 3 must be compressed so as to release the nipple. Generally this is accomplished by pushing down on the valve knob head 4. To engage the nipple on a solid support, the female receiving end of the valve assembly may be pushed down on the male nipple; otherwise the valve assembly may be compressed to open the receiving mechanism, positioned over the male nipple, and then released to lock, forming a gas-tight seal. It is advantageous to be able to compress the "workpiece" in a separate operation when the nipple is poorly accessible and a straight line for urging it onto the nipple is not readily accessible. Not all quick connect fittings are standardized; some manufacturers use slightly different or unique diameters.

Figure 4A:
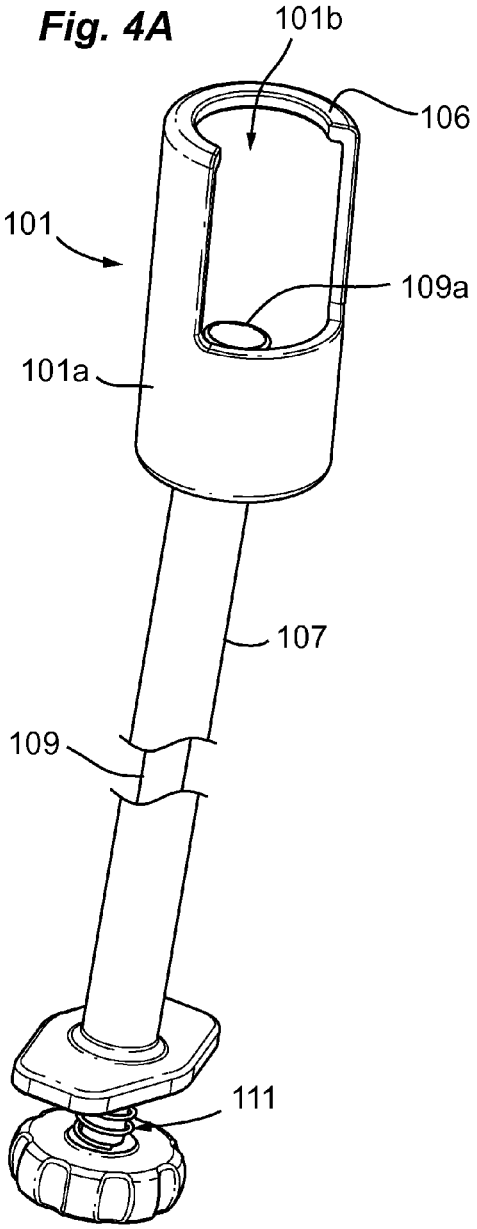
FIG. 4A is a perspective view of a tool of the invention without a workpiece.

FIG. 4A is a perspective view of a tool of the invention without a workpiece. The hollow cylindrical body 101*a* of the claw 101 (with internal catchment 102*b*) is dimensioned to receive the workpiece and is open at the top end and slotted along one side so that the workpiece can be inserted. Once inserted, an internal lip 106 on the top rim of the body wall prevents the workpiece from sliding out when the tool is inverted. Advantageously, the lip 106 also serves to engage the quick-connect locking ring 3 so that when the valve is compressed against the lip by the finger or nose end 109*a* of the actuator bar 109, the locking ring is forced into the open position. This action can be performed when the valve assembly is engaged on the nipple tap so as to release and remove it, or it can be performed by the tool before positioning and inserting the valve piece onto an open nipple. Note that this action may be performed with two fingers hooked around the handlebar 108 and a thumb on the control knob 110. Advantageously, engaging and disengaging the valve piece from a nipple can thus be performed one-handed. Also, by adjusting the length and tension of spring 111, the actuator rod tip 109*a* will maintain a gentle and constant spring pressure against the workpiece in the claw, so that it will not become dislodged or fall out when inserted into a narrow space under the hood of a vehicle.

Figure 4B:
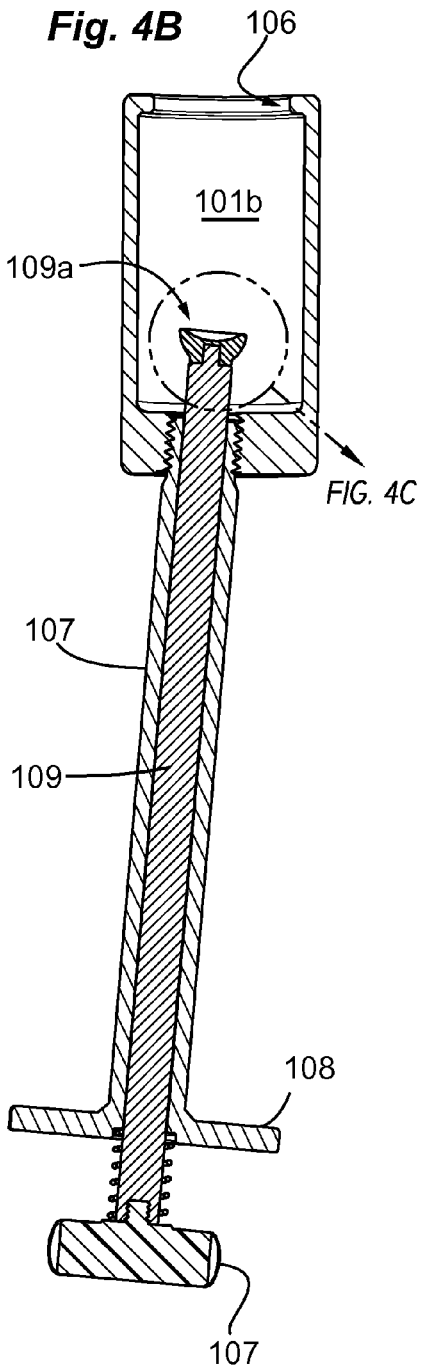
FIG. 4B is a sectional view on long axis through the tool of FIG. 4A, and shows the position of detail view FIG. 4C drawn to the suction tip of the actuator rod with the claw.

FIG. 4B is a sectional view on long axis through the tool of FIG. 4A. Guide sleeve 107 is a hollow tube with threaded end for attachment to the base of the claw. The guide sleeve has a first end attached to the base of the tool and a second end modified as a handlebar or hand grip 108. One skilled in the art will recognize that the guide sleeve may be attached to the base by non-threaded means, such a welded joint or an interference fit. Actuator rod 109 slides up and down in the guide sleeve and may also be rotated using control knob 110. While shown here with fixed length in this sectional view, it will be appreciated by those skilled in the art that the guide sleeve and actuator rod may be dimensioned to be longer or shorter as desired.

Figure 4C:
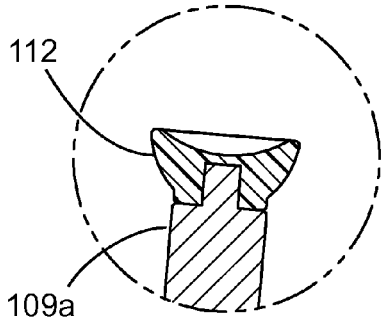

The tip or nose 109*a* of the actuator rod is inserted into the center void 101*b* of the claw and engages the valve knob end of the workpiece when present. In this instance, the actuator rod tip is modified with a stiff elastomeric suction cup 112 to aid in rotating the valve knob between open and closed. FIG. 4C is a detail view of the friction tip 112 of the actuator rod. The actuator rod tip may be advanced or withdrawn inside the claw using control knob 107 in cooperation with handlebar 108, and may also be rotated clockwise or counterclockwise to open or close the valve of the workpiece as shown in FIG. 3C.

The claw, or workpiece retainer, may be manufactured in many ways including, but not limited to, a single machined part, multiple parts, or a single casting. Materials may be any appropriate metallic or non-metallic so long as the material satisfies strength, durability and reliability requirements.

Figure 5A:
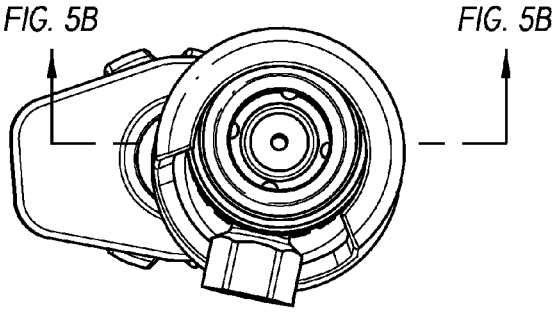
FIG. 5A is an end view showing the tool claw with workpiece in place.
Figure 5B:
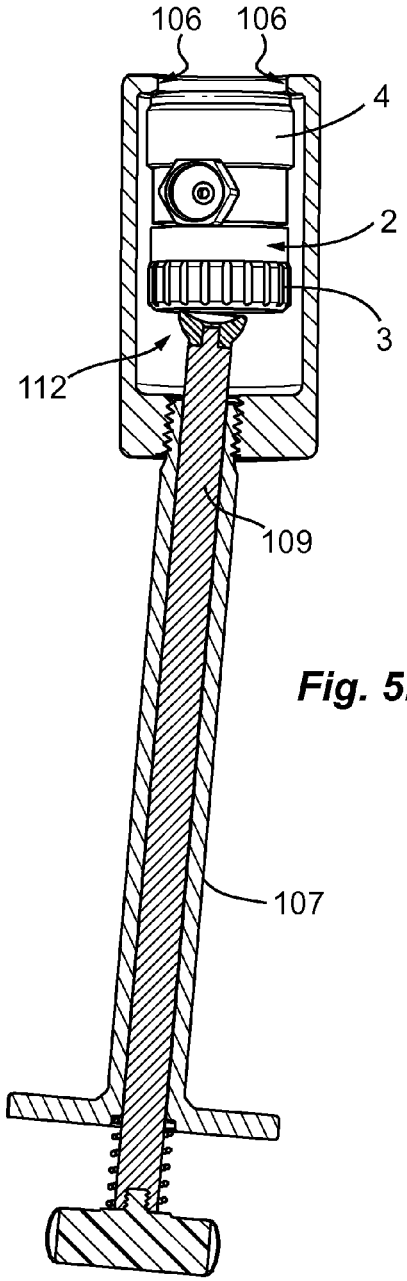
FIG. 5B is a cross-sectional view of tool through the section plane defined in FIG. 5A.

FIG. 5A is an end view showing the tool with workpiece 2 in place within the hollow center of the claw. Details of the detent mechanism of the quick-connect fitting are suggested in this rendering and are familiar to those skilled in the art. FIG. 5B is a cross-sectional view of tool 100 through the section plane defined in FIG. 5A and shows the position of the workpiece in relation to restraining lip 106 and the tip of the actuator rod (109, shown here with a friction tip 112). The "finger tip" or nose of the actuator rod may be used to provide a gentle pressure to hold the workpiece securely in the claw. As needed to unlock the quick-connect locking ring, greater pressure may be exerted by pushing the actuator rod into the claw so as to force the locking ring 4 toward the valve knob 3 (as illustrated in FIG. 3B).

Figure 6:
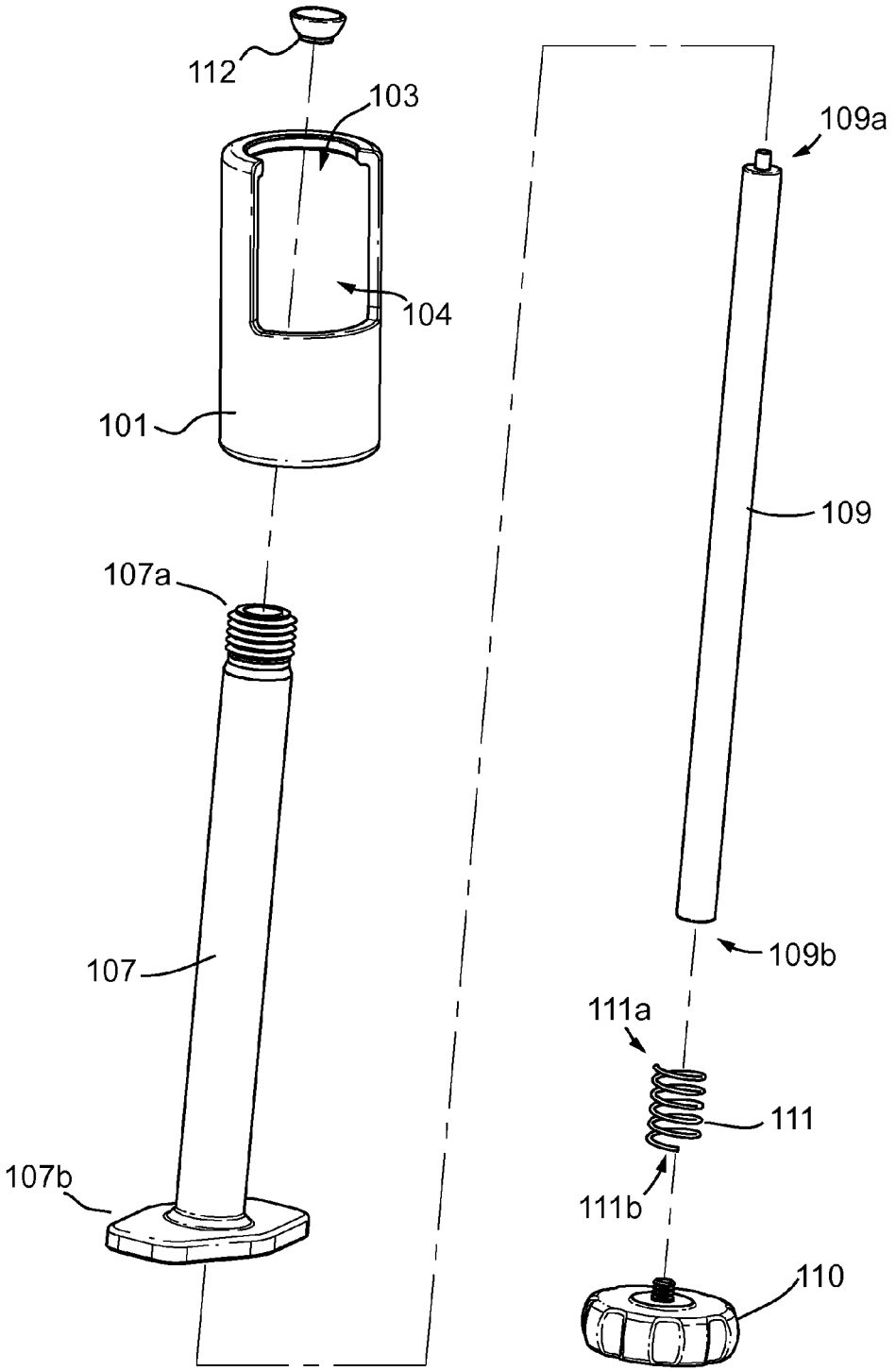
FIG. 6 is an exploded view showing details of the tool of FIG. 5.

FIG. 6 is an exploded view of the tool of FIGS. 1, 2, 4 and 5. Claw 101 is drawn to emphasize its barrel shape with side slot having a width that is slightly greater than the width of the workpiece shown in FIG. 3. Restraining lip 106 is necessarily wide enough to engage and support the quick-connect locking ring, but no so broad as to interfere with the entry of the male nipple 1 into the receiving end of the workpiece (106, FIG. 5B), as would be understood by those skilled in the art. The side slot 104 also functions to permit test fittings to be attached to the sidearm tee (5, FIG. 3A) of the workpiece (not shown). The base of the claw is drilled out to support the extension arm (guide sleeve 107) and as shown here, threaded first end 107*a* of the guide sleeve is mounted in a tapped hole in the base of the claw. Threaded guide sleeves may be provided in several lengths and are interchangeable. The second end 107*b* of the guide sleeve is modified with features useful for holding and manipulating the tool. Actuator rod 109 is assembled with a spring 111 and a control knob 110 at a second end 109*b* and can then be slid through the hollow center of the guide sleeve. The length of the actuator rod is such that nose 109*a* is disposed within the hollow center of the claw when the spring is neutral. By pinning both ends of the spring (111*a*, 111*b*), the actuator rod will always return to an unbiased, neutral position. Because the actuator rod must turn with the control knob, the spring is generally fixed at a first end to a bushing that rotates around the actuator rod while captive inside the control knob, and is affixed to the hand grip of the guide sleeve by a hook or a lock screw. Nose 109*a* of the actuator rod is shown here with a pin for mounting a fiction tip 112 useful to engage and turn the valve wheel of the workpiece. The friction tip may be a suction cup as shown, or a bung or other shape if desired, and may optionally include a sticky resin to prevent slips and firmly open or close the valve needle. For frozen valve heads, the actuator rod may be fitted with a spanner jaw designed to lock onto the valve wheel.

Figure 7:
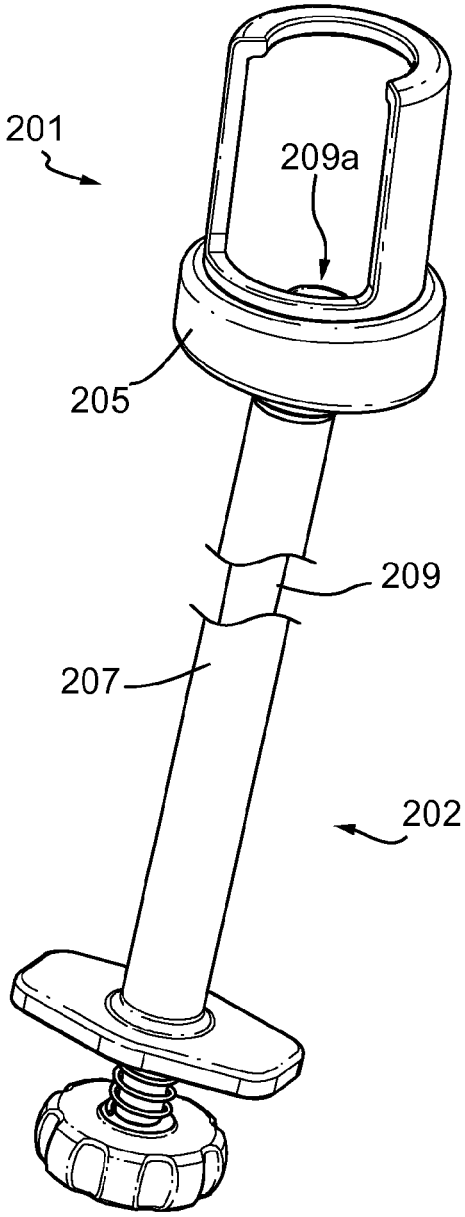
FIG. 7 is a perspective view of an alternate embodiment of the tool of the invention and includes a threaded adapter at the base of the clock for mounting the extension sleeve.

FIG. 7 is a perspective view of an alternate embodiment of the tool of the invention and includes a threaded adapter or baseplate 205 at the base of the claw. The baseplate may be threaded onto the claw and includes a hole for mounting the guide sleeve 207 and actuator rod 209 subassembly. Nose 209*a* of the actuator rod is preferably seated within the hollow pocket of the claw generally at the long axis center of the enclosure. This provides optimum rotational action of the actuator rod on the valve wheel (3, FIG. 3C). In this embodiment, additional flexibility is achieved because the baseplate may be supplied with alternate angled mounting positions for attaching the extension handle 202. Mechanics will appreciate that the tool may be optimized for use on various vehicle types by selecting the requisite tool head angle, position, and length of the extension handle. Similarly, when a claw head is required to fit a nonstandard test gauge adapter, a claw may be provided without the need for redundant but differently dimensioned extension handle. This modular construction also permits the mechanic to buy replacement parts for the set of tools without the need to buy a complete replacement set. Alternative configurations may include internal or external threading or other retention on any part or parts.

Figure 8:
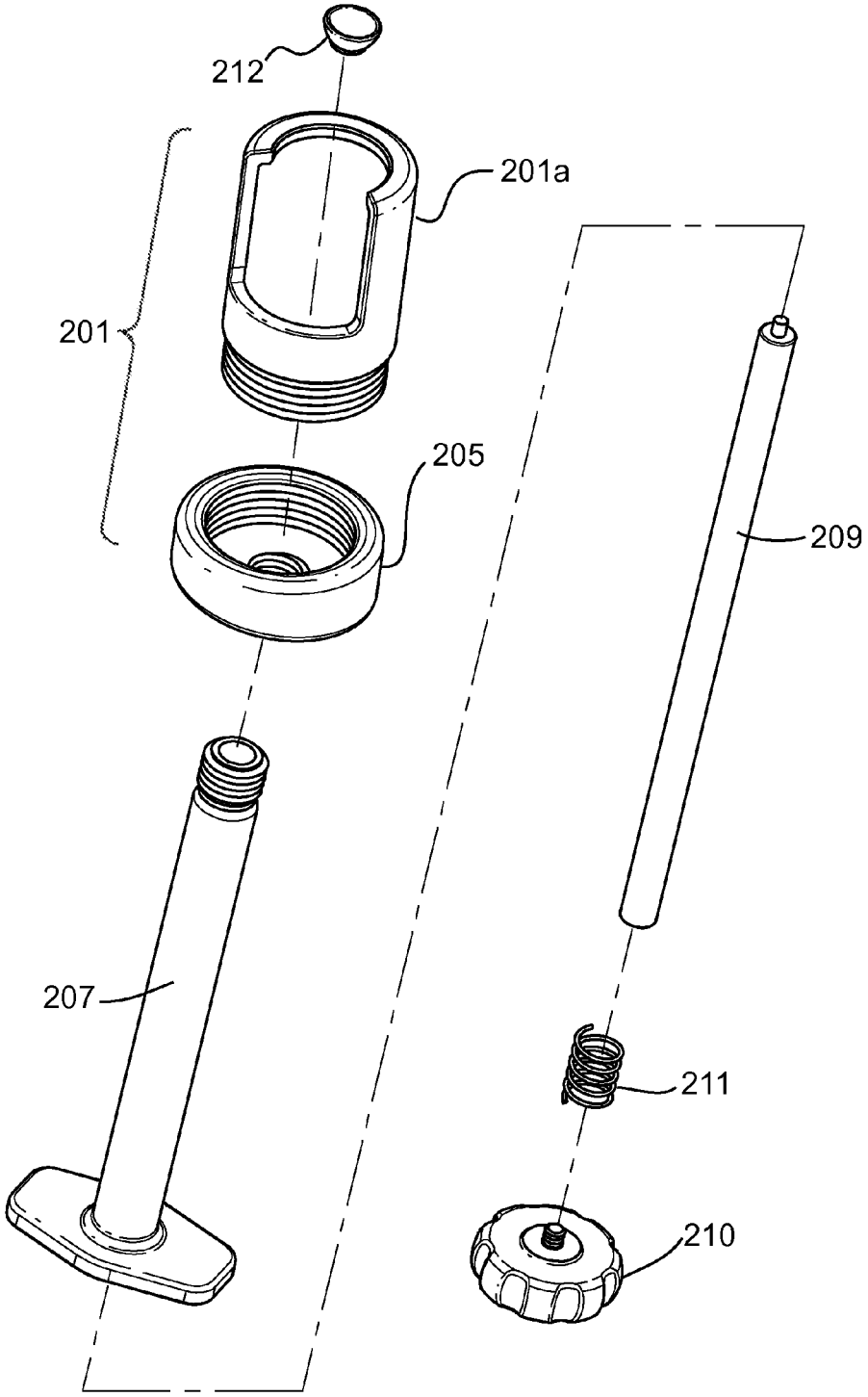
FIG. 8 is an exploded view showing details and sub-assemblies of the tool of FIG. 7.

FIG. 8 is an exploded view showing assembly details and sub-assemblies of the tool of FIG. 7. This embodiment of the inventive tool may be conceptualized as having two subassemblies: first the claw head 201 having two parts, cylindrical body 201*a* and baseplate 205, and the extension handle consisting of a guide sleeve and actuator rod subassembly. Shown here are guide sleeve 207, actuator rod 209, control knob 210, spring 211, and friction tip 212. These function analogously as described for the tool of FIG. 6.

Figure 9:
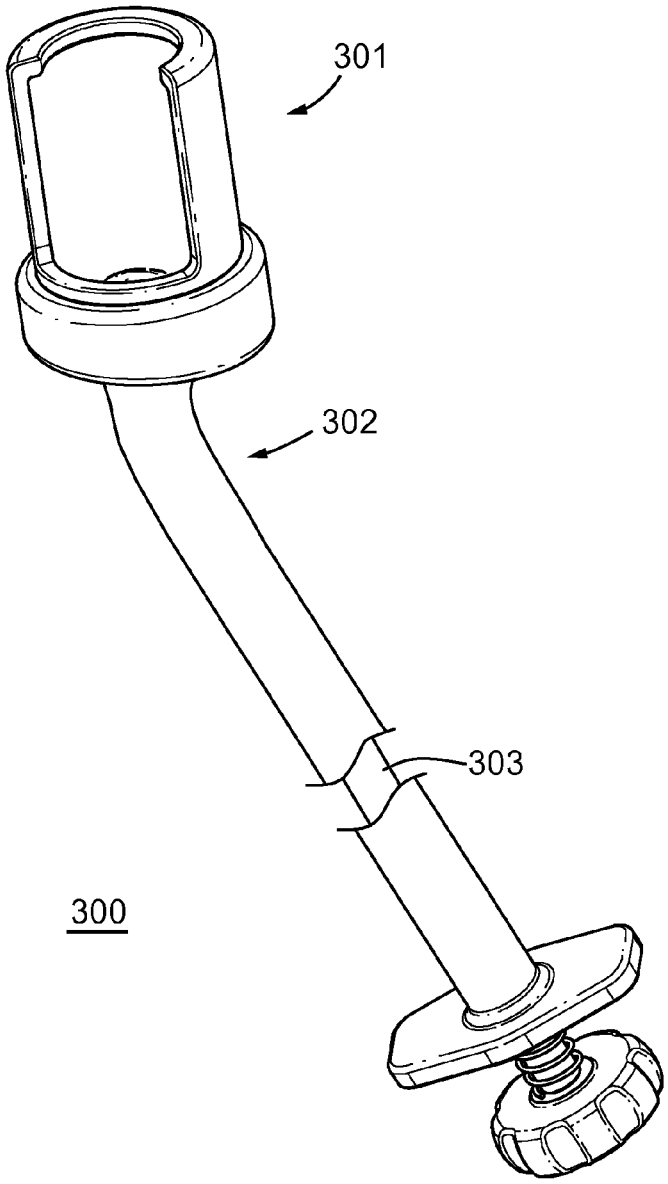
FIG. 9 illustrates a third embodiment of the inventive tool.

FIG. 9 illustrates a third embodiment of the inventive tool 300, which is modified by bending the guide sleeve 302 as needed to access taps that would otherwise be inaccessible without partial disassembly of some part of the engine, for example. In a preferred embodiment, the bent guide sleeves are provided in kits having a 30, 60 and 90 degree bent extension handle and a means for attaching the handle to a standard claw 301. Thus the claw may be supplied in one size, accompanied in the kit by several kinds of extension shafts selected for servicing a range of vehicles. The selection of extension shafts may include different lengths and different angles or bends.

Supplied with the bent guide shafts are flexible actuator rods 303. Actuator rods having the needed stiffness and flexibility are made for example from woven wire as would be familiar to those who have examined plumber's snakes. Braided cable may also be used if built to the required long-axis incompressibility. The required properties may also be achieved with a ball-chain inserted into the guidesleeve with a blunt nose at each end. A control knob and friction tip are attached after the actuator rod is inserted into the bent guide sleeve.

A 90° claw head, for example, may also be realized using a cam surface or lever at the end of the actuator rod. Examples of vehicles where servicing is difficult include late model Volkswagon Beetles, all Chrysler PT Cruisers (even though 2005 saw a minor improvement in positioning it is still too difficult to reach) and all Ford Focus models.

EXAMPLE

A tool of the invention for servicing AC systems of Chrysler PT Cruisers was constructed with an extension handle angled at 7 degrees from the base of the claw (relative to the long axis of the tool) and having a length from claw lip to guide sleeve handlebar of 18 inches. The actuator rod was made of a length of steel long enough to reach from the control knob to within the claw and the guide sleeve was formed of a shorter length of pipe having the needed internal diameter. The side slot of the claw was cut from a short length of a larger diameter pipe to which a baseplate was welded and socketed for mounting the guide sleeve. With this tool, servicing time, including change of refrigerant, was reduced in half, with a substantial increase in comfort and reliability. A synergy is achieved because the tool functions both in the attachment and detachment of the valvepiece adaptors, but also serves to open and close the valves with no interruption in the workflow. Surprisingly, it was found that these operations could be performed singlehanded because turning the control knob to open or close the valve was achieved without holding the guide sleeve handlebar because the sidearm (5, FIG. 3), once the valve is seated on a nipple, arrests rotation of the tool to no more than the least dimension of the sidewall slot. Thus a mechanic finds that his right hand for example is sufficient to operate the tool when the valvepiece is in place, and his left hand may be used to open and close a gas bottle or to operate a second tool positioned on a second tap, for example. Because both the high and low tap may need to be accessed for correct operational service, this is an advance in the art and achieves a function that is not currently feasible if one or both taps are out of reach within the engine compartment.

The inventive tool offers several improvements over the prior art, which can be summarized essentially as working the valve adaptor fitting by hand. First among these is safety. Repeated burns of the skin may lead to infection and working in close proximity to pulley belts and fan blades can lead to loss of fingers and disability. Moreover, the benefit of increased confidence during seating of the quick-connect valve on its male nipple by use of the tool is an advance in the art. This process may be performed with one hand even when the nipple is not angled so that the workpiece is conveniently pushed directly down onto the male fitting. In conventional practice, the mechanic must use his fingers to pull back the release ring while holding the valve knob against his palm. Disadvantageously, the prior art demands that the size of the opening required to emplace the valve on a nipple be sufficient to insert a hand, and poor access can lead to a misfit where the quick-release ring fails to seal properly on the nipple, thus causing gas to leak even if the valve is closed. Having the tool increases the reliability of the tap seals.

The tool provides multiple functions in a single package. Each function of the apparatus corresponds to a structural position of the component parts. In operation, the actuator rod has multiple functions and positions. Included among these are: i) a neutral position for loosely loading a workpiece in the claw; ii) an extended position for depressing a quick-connect release sleeve on a workpiece against the rim of the claw when attaching or detaching the valve adaptor from a nipple of an air-conditioning system; iii) an intermediate position for rotating the valve wheel so as to open and close the valve (either on a nipple or disengaged from a nipple); and iv) a retracted position for removing the workpiece from the claw, such as when a job is completed. Advantageously, the valve may be opened and closed without removing the workpiece from the tool, which is faster because the valve needs to be opened and closed frequently during servicing and the tool need merely be inserted over the head of the valve and the control knob pressed down under intermediate pressure to rotate the valve wheel open or closed as needed. As another feature that mechanics will find advantageous, the spring can be configured so that when the valvepiece is loaded into the claw, it is biased to return to its neutral position and exerts a gentle pressure on the valve head against the retaining lip, ensuring that the valvepiece will not accidentally fall into the moving pulley belts, for example. The spring tension may be adjusted to support heavier loads, such as a pressure gauge mounted on the sidearm or a gas feed tube.

Surprisingly, the tool provides a stronger and more steady grip on the workpiece than the mechanic's own hand, speeding and increasing the reliability of the steps of the operation and helping to minimize release of ozone-depleting gases (such as when the quick release locking ring fails to seat properly). Also, the nose of the actuator rod is modified with a friction surface, including optionally a sticky resin, so as to more readily turn the valve wheel. In practice, a stiff rubber or silastic suction cup has proved durable and effective in opening and closing the valve on/off knob.

The tool also provides the option of including a light mounted on or inside the claw, or at a point on the extension handle proximate to the claw, so as to illuminate the claw and any associated pressure gauge if desired. An LED lamp is small and requires little power, but is sufficient to assist the mechanic in determining whether the valve is open or closed, and whether the pressure in the tap is within specification, for example. A tool of the invention further having an illuminator may also be used to inspect the AC system for damage or leaking fittings, such as when used with a soap brush.

The above disclosure is sufficient to enable one of ordinary skill in the art to practice the invention, and provides the best mode of practicing the invention presently contemplated by the inventor. While above is a complete description of the preferred embodiments of the present invention, various alternatives, modifications and equivalents are possible. These embodiments, alternatives, modifications and equivalents may be combined to provide further embodiments of the present invention. Further, all foreign and/or domestic publications, patents, and patent applications cited herein, whether supra or infra, are hereby incorporated by reference in their entirety for all they teach. The inventions, examples, and embodiments described herein are not limited to particularly exemplified materials, methods, and/or structures. Various modifications, alternative constructions, changes and equivalents will readily occur to those skilled in the art and may be employed, as suitable, without departing from the true spirit and scope of the invention. Therefore, the above description and illustrations should not be construed as limiting the scope of the invention, which is defined by the appended claims.

INCORPORATION BY REFERENCE

All of the U.S. patents, U.S. patent application publications, U.S. patent applications, foreign patents, foreign patent applications and non-patent publications referred to in this specification and related filings are incorporated herein by reference in their entirety.

SCOPE OF CLAIMS

While the above is a complete description of selected embodiments of the present invention, it is possible to practice the invention use various alternatives, modifications, combinations and equivalents. In general, in the following claims, the terms used in the written description should not be construed to limit the claims to specific embodiments described herein for illustration, but should be construed to include all possible embodiments, both specific and generic, along with the full scope of equivalents to which such claims are entitled. Accordingly, the claims are not limited by the disclosure.

I claim:

1. An improved automotive hand tool for use in service requiring use of a difficult-to-access quick-connect valve, hereinafter defined as a workpiece, of the type used for R134A-compatible air-conditioning systems, which comprises:

a) a mechanical claw formed as a hollow cylinder body, said cylinder body having a rigid wall, a closed base and an open top with rim, said wall having a side slot extending from said top down said wall on one side, wherein said cylinder body with open top and side slot is dimensioned for receiving therein a workpiece disposed with valve on/off knob directed at said base, said rim is formed as an raised lip for retaining a workpiece within said cylinder and for engaging a quick-connect locking ring of a workpiece, and further wherein said side slot is dimensioned for accommodating a sidearm of a workpiece;

b) a guide sleeve attached to said base of said claw, said guide sleeve having an opening through said base at a first end and a handle at a second end;

c) a mechanical finger formed as an actuator rod dimensioned to springedly slide up and down inside said guide sleeve and to rotate therein, said actuator rod extending through said opening into said claw and having a first end with actuator nose comprising a friction tip for engaging a workpiece on the rotating surface of the valve knob and a control end extending beyond said second end of said guide sleeve, said control end comprising a knob affixed thereto, wherein said guide sleeve and mechanical finger define an extension handle assembly;

d) further wherein said actuator rod has:

i) a neutral position for loosely loading a workpiece in said claw;

ii) an extended position for depressing a quick-connect release sleeve on a workpiece against said rim of said claw when attaching or detaching a workpiece from a tap or nipple of an air-conditioning system, iii) an intermediate position for rotating a valve on/off knob on a workpiece loosely engaged in said claw so as to open and close a workpiece valve by turning said knob; and, iv) a retracted position for removing a workpiece from said claw.

2. The tool of claim 1, wherein said claw is a standard size for receiving a quick-connect T-valve and said guide sleeve and actuator rod are interchangeable according to the kind of vehicle in need of air conditioning service.

3. The tool of claim 1, wherein said nose of said actuator rod is modified with a friction surface so as to turn on and off a valve wheel of a workpiece when contactingly engaged thereto.

4. The tool of claim 1, wherein said guide sleeve is angled so as to guide said actuator nose substantially at the center of a valve wheel of a workpiece.

5. The tool of claim 1, wherein said guide sleeve is curved so as to engage said claw at a 30, 60, or 90° angle from the extension handle.

6. The tool of claim 1, wherein said extension handle assembly is interchangeable according to the kind of vehicle in need of air conditioning service and said claw is interchangeable according to the size of a workpiece to be engaged therein.

7. The tool of claim one, further comprising a spring mounted on said actuator rod and pinned at one end to a bushing mounted on said guide sleeve and at the other end to said actuator rod.

8. The tool of claim 7, wherein said raised lip is dimensioned to selectively contact a locking ring of a workpiece inside said claw.

9. The tool of claim 1, further comprising an illuminator mounted thereon.

10. A kit comprising one or more automotive hand tools of claim 1.

11. The kit of claim 10, wherein said one or more automotive hand tools comprise interchangeable claws and extension handles.

12. A method for servicing an AC system of a vehicle, which comprises providing a pair of tools of claim 1, and cooperatively using a first tool of said pair to access a first tap while using a second tool of said pair to access a second tap.

13. A kit comprising two automotive hand tools of claim 1, wherein a first tool is operable for accessing a first tap of an AC system and a second tool is operable for accessing a second tap thereof.

14. The kit of claim 13, wherein said first tool and said second tool are identical or non-identical as to size, handle length, and handle angulation.

* * * * *